US005114127A

United States Patent [19]

Everhart

[11] Patent Number: 5,114,127

[45] Date of Patent: May 19, 1992

[54] PLUMB-ALIGN DEVICE

[76] Inventor: Alvie E. Everhart, 1100 Schuman La., Petaluma, Calif. 94952

[21] Appl. No.: 575,341

[22] Filed: Aug. 29, 1990

[51] Int. Cl.[5] ..... B25B 1/20

[52] U.S. Cl. ..... 269/41

[58] Field of Search ..... 254/100, 134, 133 A, 254/424; 248/354.3, 354.5; 52/127, 125, 149, 632, 749; 269/904, 905, 41

[56] References Cited

U.S. PATENT DOCUMENTS

| | | | |
|---|---|---|---|
| 1,723,970 | 8/1929 | Jauch | 248/354.3 |
| 1,762,740 | 6/1930 | Rains | 248/359.3 |
| 2,434,949 | 1/1948 | Mueller | 254/93 H |
| 2,637,555 | 5/1953 | Klaudt | 254/100 |
| 2,895,712 | 7/1959 | Stovern et al. | 254/134 |
| 3,199,206 | 8/1965 | Snapp | 269/905 |
| 4,083,156 | 4/1978 | Tye | 269/904 |
| 4,316,601 | 2/1982 | Osborne | 254/424 |

*Primary Examiner*—Robert C. Watson
*Attorney, Agent, or Firm*—Malcolm B. Wittenberg

[57] ABSTRACT

An apparatus for conveniently plumb-aligning walls is provided. The apparatus includes an anchor for pivotally attaching the device to the ground. The anchor is attached to a support member for positioning a tubular member at a convenient height for manual manipulation. Extending upwardly from the tubular member is an extender. Attached to the end of the extender is a bracket member for clasping the top of the wall which is to be plumbed. The tubular member is equipped with a threaded rod disposed therein. The rod is received by a threaded end of the extender, so that the total length of the apparatus may be increased by rotating the tubular member in one direction, and alternatively the total length of the apparatus may be decreased by reversing the direction of the rotation of the tubular member, thereby easily and accurately plumbing the wall.

12 Claims, 3 Drawing Sheets

PLUMB-ALIGN DEVICE

FIELD OF THE INVENTION

The invention relates to bracing devices in the construction field. In particular the device is useful for plumb-aligning walls.

BACKGROUND OF THE INVENTION

Buildings are typically constructed by framing stud walls first in a horizontal position relative to the ground. The wall is then tilted to a vertical position and temporarily supported until adjacent walls are similarly framed and erected. Before the walls can be permanently connected, each wall must be plumbed, meaning the wall must be precisely positioned at a ninety degree angle with respect to the floor.

The typical approach for plumbing a wall has required at least two carpenters. One carpenter uses a diagonally positioned board ("pry board") to support the wall, while the other carpenter applies a level to the wall to determine whether and how much the wall should be moved in order to achieve a square angle relative to the ground. If the wall is not plumb, the leveling carpenter tells the other carpenter (the racking carpenter) to move the pry board. The racking carpenter then kicks or taps the board to alter the alignment of the wall.

Plumbing and aligning an average house typically requires approximately 20 or more 2×4's of 12 to 18 feet in length as pry boards. The 2×4's are used as temporary braces to push or pull a wood framed wall in or out until the joists are in place. The bigger the building, the more of these temporary braces are required. It is often very difficult to push or pull a wall in from the outside of the building, especially on a second or third floor. Labor is required to drive stakes into the ground to support the 2×4's and later to pry stakes up for further use. The various 2×4's which are placed during construction to plumb and align the wall further create a hazardous condition for workers who find themselves tripping over or bumping into the braces as they try to maneuver joists or other materials through the building for the next phase of construction.

Another problem with the use of 2×4 pry boards for plumbing walls is that kicking or tapping the prying board to establish precise and accurate alignment is unsatisfactory. The racking carpenter is not capable of making the requisite fine adjustments. Further, for one carpenter to rely on the oral directions of the other provides a degree of uncertainty as to how much racking is necessary. Also, the requirement of two carpenters needlessly increases labor costs.

Prior inventors have proposed solutions to the problem such as the device disclosed in U.S. Pat. No. 4,660,806. This device includes a hydraulic jack for racking the wall from a remote position. The problem with this device is that it only allows the carpenter to make fine adjustments in one direction.

Another one-carpenter plumbing device is disclosed in U.S. Pat. No. 4,870,741. The device includes a rope and pulley fastened between interfacing erect walls. However, this device is not useful for plumbing a single independent wall.

Therefore, it is an object of the present invention to provide a device useful for plumbing a wall, which is designed for making fine adjustments in either of opposite directions for pushing or pulling the wall into plumb alignment.

Another object of the invention is to provide a device which allows a single carpenter to accurately plumb a wall.

Another object is to provide a safer technique for plum-aligning walls, then is currently available.

Another object is to provide a plumb-align device which is more cost and time efficient than prior devices.

SUMMARY OF THE INVENTION

The above objectives are accomplished with the plumb-align device of the present invention. The device is equipped at one end with an anchoring means for contacting the ground and resisting movement relative to the ground. Attached to the anchoring means is a support means for pivotally connecting the anchoring means to a tubular member disposed at a convenient height for manual manipulation. The tubular member has a threaded rod disposed therein, to be received in a threaded end of an extender which reaches upwardly from the tubular member to the top of the wall. The reach of the extender can be finely adjusted by rotating the tubular member, so that the threaded rod moves relative to the threaded end of the extender. The top of the plumb-align device is equipped with a bracket means for clasping the top of the wall. The total length of the apparatus may be increased by rotating the tubular member in one direction and alternatively the total length of the apparatus may be decreased by reversing the direction of rotation of the tubular member, thereby easily and accurately plumbing the wall.

DETAILED DESCRIPTION OF THE DRAWINGS

Figure 1:
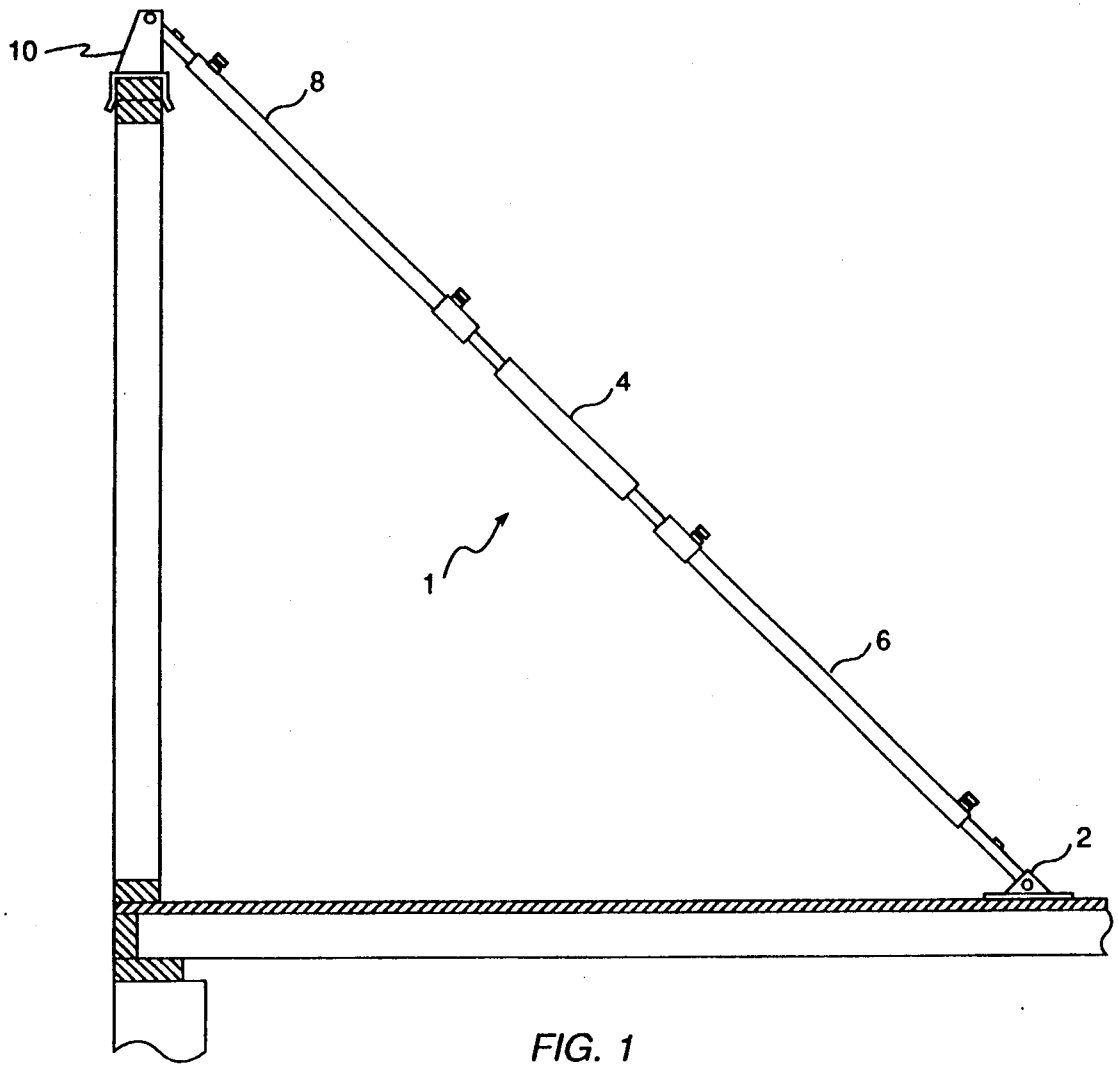
FIG. 1 is a side view of the plumb-align device of the present invention spanning between a floor and a wall.

FIG. 1 shows a typical embodiment of the plumb-align device I of the present invention. At one end of the device is an anchoring means 2 for preventing that end of the device from moving relative to the ground. Preferably the anchoring means 2 is provided with holes so that it may be temporarily fastened by nail or screw to the floor.

Attached to the anchoring means is a support means 6 for pivotally connecting the anchoring means 2 to a tubular member 4, and positioning said tubular member 4 at a convenient height for manual manipulation. Extending upwardly from the tubular member 4 is an extender 8 for reaching the top of the wall. Attached to the distal end of the extender 8 is a bracket means 10 for clasping the top of the wall.

Figure 3:
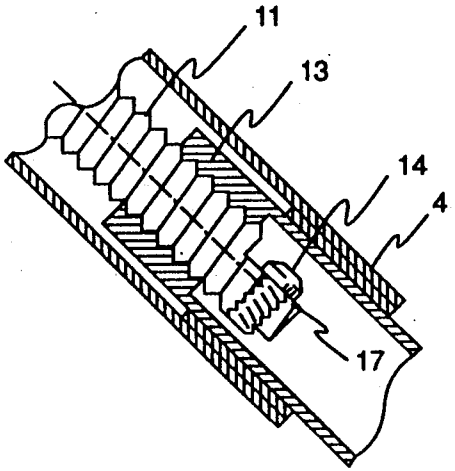
FIG. 3 is a partial sectional view of one embodiment of the present invention.
Figure 2:
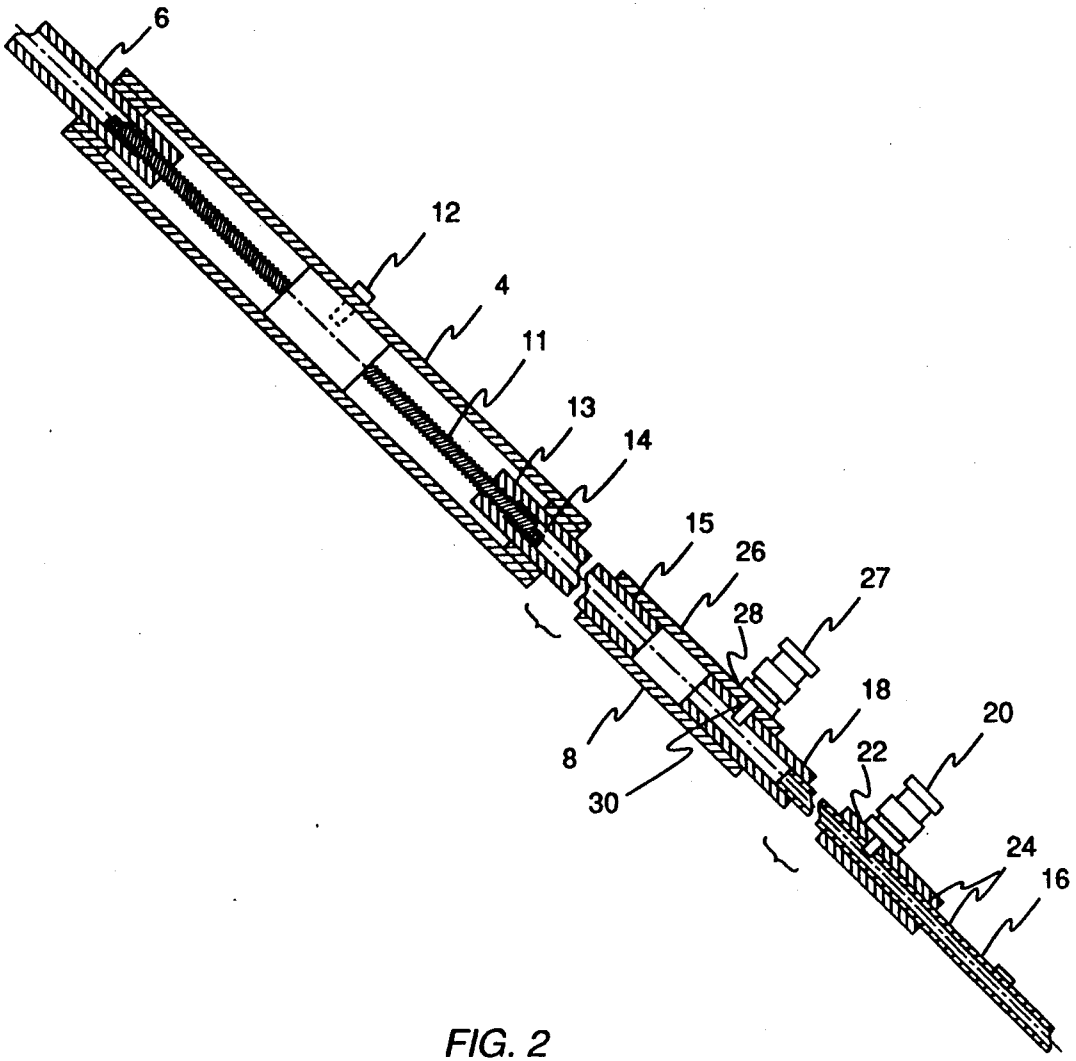
FIG. 2 is a partial side sectional view of a preferred embodiment of the present invention.

The plumb-align device is also equipped with a means for extending or retracting extender 8 in response to rotation of the tubular member 4. A preferred means for adjusting the length of the plumb-align device 1, is shown in FIG. 2. The device in FIG. 2 shows the tubular member 4 having a threaded rod 11 disposed therein. The rod 11 is centrally fixed within the tubular member 4 by a pin 12. The extender 8 has a threaded end 13 dimensioned to receive the threaded rod 11. The end of the threaded rod 11 is equipped with a knob 14 for preventing the rod 11 from being inadvertently removed from the extender 8. In a preferred embodiment, the nob is a screw dimensioned to be received in a threaded hole in a flattened portion 17 located at the end of the rod 11, as shown in FIG. 3. The tubular member 4 has a hole allowing insertion of the screw after the rod 11 has been screwed into the extender 8.

It can be seen from FIG. 2 that the screwlike engagement between the threaded rod 11 and the threaded end of the extender 8, allows the degree of extension to be finely adjusted in a caliper-like manner. The gauge of the threads on the rod 11 and the extenders threaded end 13 determines the adjustment precision of the plumb-align device.

In a preferred embodiment a nylon ring 15 is disposed between the tubular member 4 and the extender 8. The ring 15 is made of a material which allows the extender 8 to move relative to the tubular member 4.

One embodiment of the plumb-align device includes a telescoping means for making gross adjustments in the length of the extender 8. Such a means is shown in FIG. 2. In FIG. 2 the extender 8 has a first tube 16 engaged with a second tube 18. Tube 16 is equipped with holes 24 for receiving a pin 20. The second tube 18 is equipped with at least one hole 22 also for receiving pin 20. Gross adjustments to the length of the extender 8 may be made by disengaging the pin 20, sliding the first tube 16 relative to the second tube 18 and reengaging the pin through hole 22 and another of the first tube holes 24.

The extender 8 may also be equipped with a means for completely changing or replacing a portion of the extender. Such a means is shown in FIG. 2. The extender 8 may include a third tube 26 engaged with an end of the second tube 18 opposite from the first tube 16. The third tube 26 has a hole 28 for receiving a pin 27. The second tube 18 also has a hole 30 for receiving the pin 27, so that the first and second tubes of the extender 8 may be detached and replaced by disengaging the pin 27, removing the second tube 18 from the third tube 26, and replacing with another extender portion.

In a preferred embodiment pins 20 and 27 are spring biased. A lower portion of each pin is welded to the outer surface of the tube. The pin is disengaged by lifting the pin head. Once the tubes are repositioned, the spring urges the pin back into engagement with the aligned holes.

Figure 4:
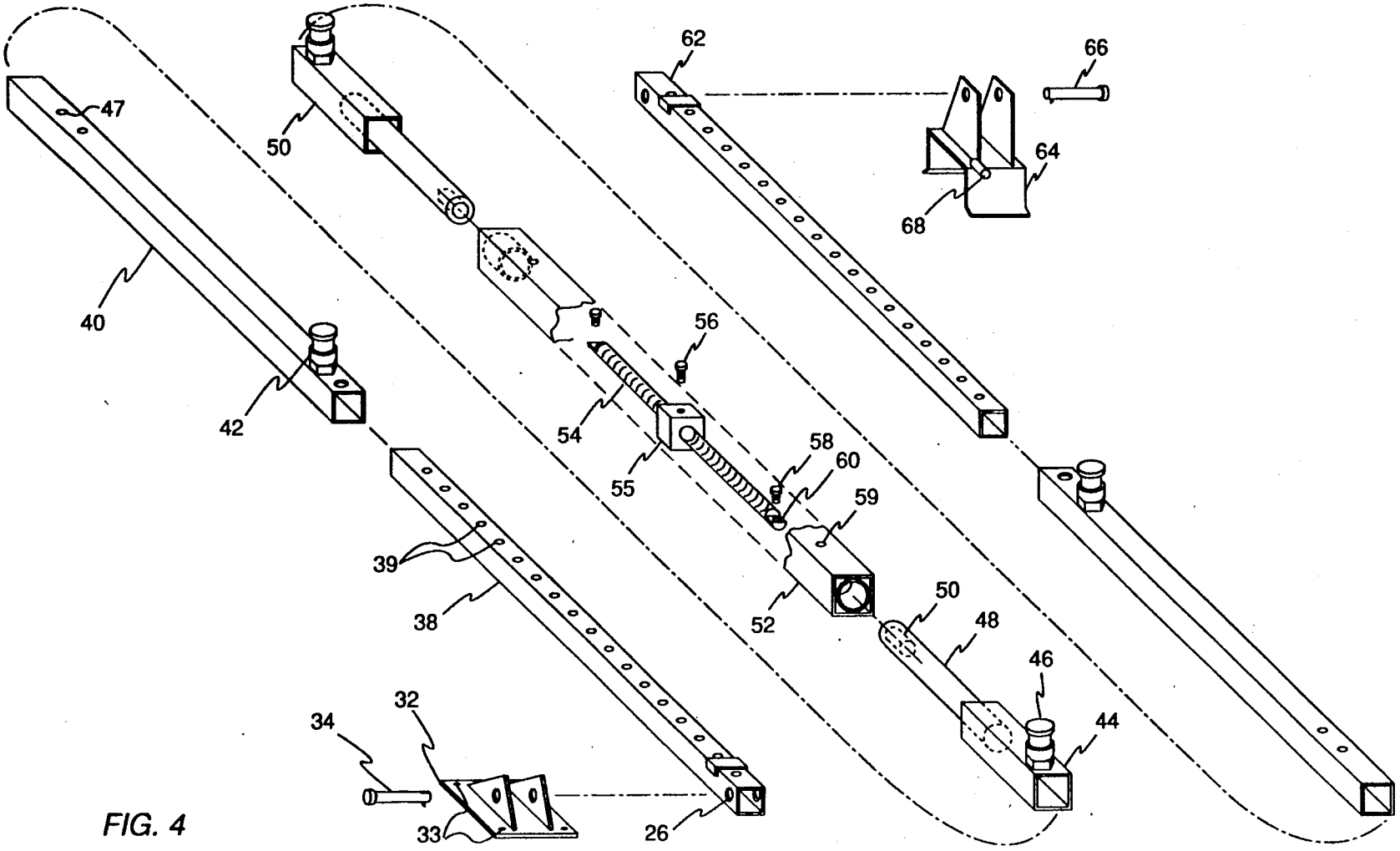
FIG. 4 is an exploded perspective view of a preferred embodiment of the present invention.

In one embodiment of the present invention only a single extender is provided. In this embodiment, rotation of the tubular member 4 will only cause length adjustments on one side of the plumb-align device. However, in another embodiment of the invention, two extenders are attached in a symmetrical configuration to the tubular member. This embodiment is shown in FIG. 4. It can be seen that with the two extender embodiment, rotation of the tubular member causes length adjustments in both directions relative to the tubular member. The two extender embodiment allows twice the amount of extension per revolution of the tubular member, in comparison to the single extender embodiment.

FIG. 4 shows an anchoring means 32 provided with holes 33 so that it can be nailed or screwed to the floor. The anchoring means 32 is pivotally attached to one end of a square tube 38 by a screw 34. The square tube 38 has a series of holes 39 so that said tube can be telescoped in and out of square tube 40. One end of square tube 40 has at least one hole and complimenting pin 42 which is set to engage one of the holes 39 in square tube 38, thereby fixing the position of tube 38 relative to tube 40.

The other end of tube 40 is dimensioned to receive a third tube member 44. Tube 44 is equipped with a pin 46 which can be removably inserted through a hole 47 in tube 40. Release of the pin 46 is intended to allow complete exchange of the telescoping set of tube 38 and 40 for another set. Such an exchange, for example could adapt the apparatus for use on a two story wall rather than a one story wall.

The tube member 44 in FIG. 4 is circular at one end 48, and is internally threaded 50 for receiving one end of a threaded rod 54. Said rod is fixed within square tubular member 52 by block 55 and screw 56. One end of rod 54 has a flat portion 60 which has a hole for receiving screw 58. Screw 58 is screwed into rod 54 through hole 59 after the female threaded potion 50 of tube member 44 has engaged the male threaded portion of rod 54, thereby preventing inadvertent removal of tube member 44 from square tubular member 52.

The apparatus in FIG. 4 is symmetrically equipped with two extenders, except that the end attachments are different. Extender 60 is identical to the extender already described by reference to parts 38 through 59, except that the distal end 62 of extender 60 is equipped with a bracket 64 which is pivotally attached by screw 66. The bracket 64 is shaped so that it will clasp the top of the wall to be plumbed. The bracket 64 may also include an arm 68 for suspending a "plumb bob" for indicating the vertical direction next to the wall.

Though the invention has been primarily designed for plumb-aligning walls, those skilled in the art will appreciate that the invention will be useful for many types of bracing applications.

What is claimed is:

1. An apparatus for plumbing a wall comprising:

anchoring means for contacting the ground, adapted to resist movement relative to the ground;

a tubular member having a threaded rod fixed therein, a support means for pivotally connecting said anchoring means to said tubular member so as to position said tubular member at an appropriate height for manual manipulation;

an extender having a threaded end dimensioned to receive an end of the threaded rod, said threaded rod being engaged with said extender end so that rotation of the tubular member causes the threaded rod to screw in or out of the extender depending on the direction of rotation;

bracket means for clasping the wall, the wall having a top edge, the bracket means being adapted to pivotally connect the top edge of the wall to the end of the apparatus opposite from the grounded end, whereby the total length of the apparatus may be increased by rotating the tubular member in one direction and alternatively the total length of the apparatus may be decreased by reversing the direction of rotation of the tubular member, thereby easily and accurately plumbing the wall.

2. The apparatus of claim 1, wherein said support means is another extender having a threaded end dimensioned to receive an end of the threaded rod, the extenders being engaged to opposite ends of the rod, so that rotation of the tubular member causes both extenders to simultaneously retract or extend depending on the direction of tubular member rotation.

3. The apparatus of claim 1, further comprising:

varying means for altering the length of the extender.

4. The apparatus of claim 3, wherein the varying means includes:

a first pin, the extender having a first tube engaged with a second tube, the first tube having a series of holes, the second tube having at least one hole, the pin being inserted through the second tube hole and one of the series of first tube holes, whereby the length of the extender may be varied by removing the pin, sliding one tube relative to the other and reinserting the pin through the second tube hole and another of the first tube holes.

5. The apparatus of claim 1, further comprising:

replacement means for changing a replaceable portion of one of the extenders.

6. The apparatus of claim 5, wherein the replacement means includes:

a second pin, the extender having a third tube engaged with the second tube at an end opposite from the first tube, the second tube having a second hole, the third tube having a hole, the second pin being inserted through the second hole of the second tube and the hole of the third tube, whereby the first and second tubes of the extender may be detached and replaced by removing the second pin, disengaging the second tube from the third tube, and replacing with another extender portion.

7. The apparatus of claim 1, further comprising:

a ring member disposed between the extender and the tubular member, whereby the ring member allows the tube to slide relative to the tubular member.

8. The apparatus of claim 7, wherein the ring member is made of nylon.

9. The apparatus of claim 2, further comprising:

two knobs disposed at opposite ends of the rod, the threaded ends of each extender having a collar, so that when the apparatus is fully extended the knobs butt against the extender collars, thereby preventing the apparatus from coming apart.

10. An apparatus for plumbing a wall, comprising:

a tubular member having two end sections;

two extenders, each having an end portion engaged with one of the tubular member end sections;

anchoring means for fixing the position of an end of the apparatus with respect to the ground;

bracket means for attaching the apparatus to the wall;

fine adjustment means for increasing the total apparatus length by rotating the tubular member in one direction, and decreasing the total apparatus length by reversing the direction of tubular member rotation.

11. The apparatus of claim 10, wherein the adjusting means includes:

a threaded rod fixed inside the tubular member, at least one of the extenders having a threaded end engaged with an end of the rod, so that rotation of the rod causes the extender to move relative to the tubular member.

12. A bracing apparatus for adjusting and maintaining the distance between two surfaces, comprising:

a male rod member having first and second ends, said first end being adapted to butt against one of the surfaces to be braced while allowing said rod member to be rotated relative to the surface, said second end being threaded; and a female extender having first and second ends, said first extender end being adapted to butt against the other surface to be braced, said second extender end being threaded so as to receive said second end of the male rod member, whereby the total length of the apparatus may be increased by rotating said male rod member in one direction and alternatively the total length of the apparatus may be decreased by reversing the direction of rotation of said male rod member, thereby easily and accurately adjusting the distance between the two surfaces.

* * * * *